United States Patent [19]

Yoshida

[11] Patent Number: 4,763,596

[45] Date of Patent: Aug. 16, 1988

[54] SEMISUBMERGED WATER SURFACE NAVIGATION SHIP

[76] Inventor: Toshio Yoshida, 1-2-23, Rikyumae-Machi, Suma-Ku, Kobe-Shi, Hyogo-Ken, Japan

[21] Appl. No.: 917,369

[22] Filed: Oct. 9, 1986

[30] Foreign Application Priority Data

Oct. 9, 1985 [JP] Japan ..... 60-223812
May 28, 1986 [JP] Japan ..... 61-120986

[51] Int. Cl.[4] ..... B63B 1/12

[52] U.S. Cl. ..... 114/256; 114/265; 114/61; 114/332

[58] Field of Search ..... 114/264, 265, 266, 267, 114/256, 257, 322, 339, 259, 260, 261, 125, 312, 332

[56] References Cited

U.S. PATENT DOCUMENTS

| | | | |
|---|---|---|---|
| 4,174,671 | 11/1979 | Seidl | 114/265 |
| 4,440,103 | 4/1984 | Lang | 114/125 |
| 4,452,166 | 6/1984 | Daniel | 114/61 |
| 4,552,083 | 11/1985 | Schmidt | 114/61 |
| 4,606,291 | 8/1986 | Hoppe | 114/61 |
| 4,665,853 | 5/1987 | Gerdsen | 114/61 |

FOREIGN PATENT DOCUMENTS

| | | | |
|---|---|---|---|
| 56-53983 | 5/1981 | Japan | 114/256 |
| 2123354 | 2/1984 | United Kingdom | 114/256 |

OTHER PUBLICATIONS

Hawkins, S. et al., "Hydrofoil Operational Performance Enhancement Using Hybrid Design Options," AIAA Publication No. 78-750 from AIAA/SNAME Advanced Marine Vehicles Conference, San Diego, Calif., Apr. 17-19, 1978, p. 1.

*Primary Examiner*—Sherman D. Basinger
*Assistant Examiner*—Clifford T. Bartz
*Attorney, Agent, or Firm*—Wenderoth, Lind & Ponack

[57] ABSTRACT

A semisubmersible water surface navigation ship with even draft comprising at least two lower hulls, which can be submerged under water to reduce resistance and have a shape affording low friction resistance, and which are equipped with lifting and diving planes, at the bow and stern parts, and an upper hull above the water surface being connected to the lower hulls by way of water breakers. In order to keep an even draft or trim during navigation, the lifting/diving force capacity of the lifting and diving planes is designed to be greater than the buoyancy change of the water breakers owing to loads such as waves and wind. Steering rudders, propellers and water ballast tanks are installed in order to cause the ship to navigate or lie to under any one of a shallow draft state, a semisubmerged state and a deep submerged state. The upper hull is provided with superstructures with sufficient reserve buoyancy for maintaining the stability of the ship under the deep submerged state. Barges carrying cargoes can be mounted on or dismounted from the upper hull in the deep submerged state, and thus they can be loaded and unloaded in an integrated manner.

17 Claims, 3 Drawing Sheets

SEMISUBMERGED WATER SURFACE NAVIGATION SHIP

BACKGROUND OF THE INVENTION

This invention relates to semisubmerged water surface navigation ships and more particularly to a water surface navigation ship comprising lower hulls normally submerged below the water surface, an upper hull normally above the water surface, and water breakers connecting the lower hulls and the upper hull and being normally afloat on the water surface.

The history of ships and shipbuilding shows only slight changes basically from ancient times to the present time. That is, all ships including ancient dugout log canoes and huge modern vessels become afloat by the principle of buoyancy arising from the displaced water. The use of propellers in the place of sails and oars may be one of the small changes in the history of shipbuilding.

The widespread appearance of submerged ships in this century was a big revolution in ship building technology, although they are used mostly for military purposes. The characteristics of a submerged ship are as follows.

1. The main resistances of water against surface floating ship propulsion are frictional resistance and wave-making resistance. When the speed of the ship is increased, the wave-making resistance becomes greater. As there is no wave-making resistance for submerged ships, an absolute advantage exists for high-speed navigation of a submerged ship.

2. As a submerged ship submerges under water, it is not subject to any influence of waves, wind, etc. Therefore no rolling or pitching motion occurs.

3. As a submerged ship submerges under water, it cannot use engines which consume oxygen from the air. Instead, it must use non-oxygen type engines such as battery engines, nuclear power engines, etc.

4. As a submerged ship submerges under water, it has no reserve buoyancy, so it needs a special lifting/diving system such as water ballasting equipment or lifting-/diving plates in order to navigate or lie to with ample stability.

The ever continuing goal of shipbuilding technology is to produce "faster, stabler, safer and more economical" ships. It is only 100 years since ships were constructed by modern shipbuilding technology. In order to reach the above goal, higher power engines are installed for higher speed, greater breadth and length of ship hulls are designed for stabler ships with less rolling and pitching, greater reserve buoyancy is added for safety, and greater dead weight is sought for economy.

However, no matter how high the power of an engine may be for higher speed, the wave-making resistance owing to surface waves increases in a geometric progression, and thus the speed of a ship cannot exceed a certain limitation. No matter how large the breadth and length of ship hull may be for the purpose of attaining stability, the ship cannot avoid the effect of waves and wind as long as it is afloat on the water surface. Recently, devices such as stabilizers have been used for this purpose, but as the ship hull becomes bigger, its reserve buoyancy becomes greater, and thus the added buoyancy becomes large which makes it difficult to control the motion of ship by means of such devices. The appearance of submerged ships has solved these problems in shipbuilding technology. For example, a water surface navigation ship of 30,000 DWT cannot use stabilizers or underwater horizontal rudders or plates to control the rolling or pitching owing to change of buoyancy because of the excessively great change in the buoyancy induced by waves and/or wind. In contrast, a fully submerged ship of 30,000 DWT has no reserve buoyancy and no buoyancy change capacity, and therefore horizontal rudders or plates with the minimum lifting/diving capacity can control the motion of the ship.

As is well known, recent rapid transportation of cargo is being done more by aircraft than by ship. This is because marine transportation by ship takes a longer time, cargo can be damaged on account of rough weather during transportation, the loading and unloading of massive ship cargo are troublesome and apt to cause damage, and their custom work takes a longer time.

In general port operation, crane work is carried out twice, i.e., one for loading and unloading of cargo and the other is for sorting the cargo. The first crane work is time consuming and costly but is not performed for sorting which is carried out afterwards and separately. No matter how inexpensive marine transportation may be, it must lose the major role in transportation as long as air transportation can provide fast, safe and punctual door-to-door deliveries.

SUMMARY OF THE INVENTION

The main object of this invention is to solve the above stated various problems encountered in the conventional marine transportation.

The basic principle of this invention is the utilization, in a semisubmerged water surface navigation ship, of the advantageous characteristics of both a submerged ship with no wave making resistance and with no effect of wave and wind due to no reserve buoyancy and a water surface navigation ship with the stable and safer surface navigation performance.

The semisubmerged water surface navigation ship according to this invention comprises at least two submersible lower hulls which support the total weight when they are fully submerged, these lower hulls not encountering any wave-making resistance, and an upper hull which is equipped with navigation equipment and is used to carry cargoes above water surface, the submerged lower hulls and the upper hull being connected by water breakers.

The water breakers are designed to have minimal buoyancy change due to waves and wind. In other words, rolling or pitching induced by the change of buoyancy can be controlled by horizontal rudders or lifting and diving hydroplanes which are provided at the bow and stern parts of the submersible lower hulls and have lifting/diving capacity which is greater than the buoyancy change of the water breakers. The rolling and pitching of the ship caused by the buoyancy change of the water breakers are due to waves, wind or turning motion of the ship and can be eliminated by the operation of the lifting and diving planes by means of an electronic control system. The draft of the ship can be controlled to be even by the lifting and diving planes so that the transportation can be most economical at high speed.

For these reasons, the water breakers should be designed so as to have the minimum reserve buoyancy and should be designed as slender as possible so as to encounter minimum wave-making resistance in the afloat navigation state.

The lower hulls have water ballast tanks which enable the ship to assume a deep draft state wherein the upper hull is also submerged. The upper hull is advantageously provided with superstructures which provide added buoyancy to guarantee stability of the ship, and loading and unloading work at a port can be done with the ship in this deep draft state which is obtained by ballasting water into the ballast tanks. Since cargoes are already sorted on a number of barges mounted on the upper hull separately for the destination, the barges can be floated apart from the ship in the unloading operation. The loading operation can be done similarly. That is floating barges carrying cargoes previously sorted separately for each destination are mounted on the upper hull of the ship in the deep draft state.

These loading and unloading modes can minimize the cargo handling time at port, enhance the efficiency of navigation ship and, further, simplify port facilities such as lifting cranes and warehouse equipments because cargoes are previously sorted on individual barges.

Thus, this invention provides a semisubmerged water surface navigation ship which is most effective for developing a fast, stable, safe and economical mass transportation system.

The nature and utility of this invention will be more clearly apparent from the following detailed description with respect to preferred embodiments of this invention when read in conjunction with the accompanying drawings, briefly described below.

DETAILED DESCRIPTION OF THE INVENTION

Figure 1:
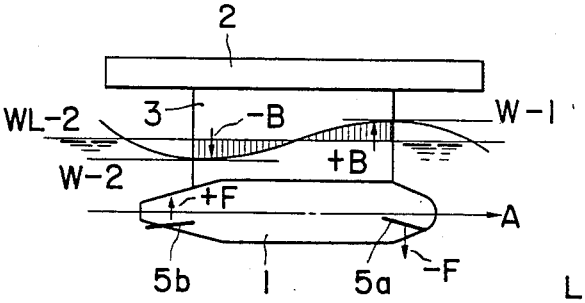
FIG. 1 is a side view showing the basic concept of the semisubmerged water surface navigation ship according to this invention.
Figure 2:
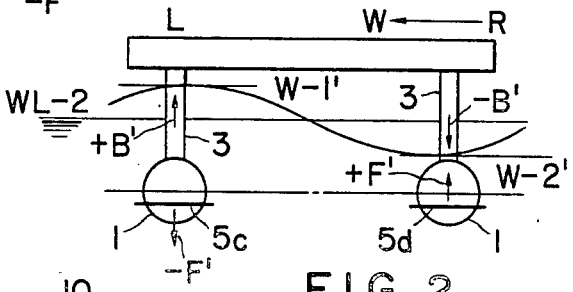
FIG. 2 is a rear view of the ship shown in FIG. 1.

Referring to FIGS. 1 and 2 of the drawings, showing the basic concept of this invention, the semisubmerged water surface navigation ship shown therein comprises two lower hulls 1, an upper hull 2 and water breakers 3 extending vertically between the lower hulls 1 and the upper hull 2 to fixedly connect the same.

The lower hulls 1 are disposed in parallel relation and submerged normally below the water surface, while the upper hull 2 is normally above the water surface with the water breakers 3 afloat at the water surface. The water breakers 3 are, for example, in the form of an upstanding plate. The upper hull 2 is shown as a horizontal platform 2.

Bow and stern horizontal planes 5*a* and 5*b* are provided at the fore and aft parts of the two lower hulls 1. These planes 5*a* and 5*b* are controllable electronically to produce lifting/diving force by changing the attack angle thereof.

The buoyancy change owing to elevating and lowering of the water surface of the water breaker 3 is, according to this invention, less than the lifting/diving forces of the lifting and diving planes 5 as will be described later.

FIG. 1 shows the ship navigating at the water surface WL-2 with the lower hulls 1 submerged therebelow and with the water breakers 3 afloat at the water surface. Let it be assumed that the ship undergoes longitudinal waves having an elevated water line or surface W-1 at the fore part of the water breakers 3 and a lowered water line or surface W-2 at the aft part of the same.

In order to resist the buoyancy increment +B due to the draft increment at the fore part of the water breaker, a diving force −F is generated by turning the bow planes 5*a* at the fore part of each lower hull 1. Each water breaker 3 is so designed that the absolute value of the buoyancy change +B of the water breaker 3 will be less than the absolute value of the diving capacity −F of the bow planes 5*a*, whereby it is possible to keep the water depth of each lower hulls 1 unchanged relative to the water surface WL-2 at the fore part of the water breaker 3. Similarly it is possible to keep the water depth of the lower hulls 1 unchanged relative to the water surface WL-2 at the aft part by designing the water breaker 3 so that the absolute value of the buoyancy decrement −B due to lowering of water surface will be less than the absolute value of lifting capacity +F generated by turning the stern planes 5*b*.

FIG. 2 shows a position of the ship subjected to a transverse wave, a wind force W, and the effect of a turning force. The water surfaces of the port and starboard water breakers 3 are W-1′ and W-2′, respectively. Against the buoyancy increment +B′ of the port water breaker 3 due to the increment of draft, the diving force −F′ is generated by controlling the port horizontal planes 5*c*. Similarly, against the buoyancy decrement −B′ of the starboard water breaker 3 due to the decrement of draft, the lifting force +F′ is generated by controlling the starboard horizontal plane 5*d*, in which the water breaker 3 is so designed that the absolute value of the buoyancy change ±B′ of the water breaker 3 will be less than the absolute value of the vertical forces ±F′ generated by the planes 5*c* and 5*d*, whereby it is possible to keep the water depth of lower hulls 1 unchanged relative to the water surface WL-2.

The control of bow and stern planes 5a and 5b and the port and starboard planes 5c and 5d can be done with no problem by the use of known modern electronic control technology.

According to the operation principle described above, the ship can navigate with an even draft or trim in the semisubmerged state. More specifically, when the ship is navigating in the A-direction on the water surface WL-2, the lifting and diving planes, which have a lifting/diving capacity greater than the buoyancy change of the water breakers 3, can be controlled according to the wave height, wave length, wave travelling speed, wind force and forces due to turning. It will be clear from the above description that the less the buoyancy change B is, the less will be the lifting capacity F of the horizontal plane. The extreme case of zero buoyancy B corresponds to the water breaker with no reserve buoyancy, implying a fully submerged body with no water surface which cannot navigate or remain poised under water without the help of a special ballasting system or lifting and diving planes.

Another extreme case of very large buoyancy corresponds to the ordinary surface navigation ship with ample reserve buoyancy and ample stability in general. In the case of these ordinary ships, however, the buoyancy change due to external load such as wave, wind, etc. is very large. Thus it is not possible for these ships to navigate while keeping the draft even and controlling the rolling and pitching motions at a minimum or zero by the use of the capacity of lifting and diving planes as discussed above.

Figure 3:
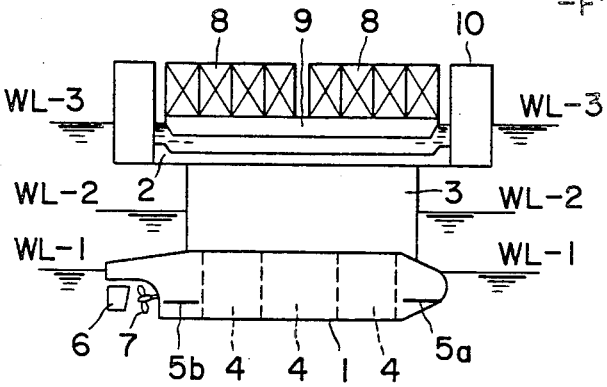
FIG. 3 is a side view of the semisubmerged water surface navigation ship installed wtih superstructures and carrying barges.

FIG. 3 shows the ship in a modified form in a deep draft state in which the upper hull 2 is submerged to a water surface WL-3. Afloat barges 9 can be loaded onto or unloaded from the upper hull 2 while carrying cargo 8. FIG. 3 illustrates the state of barges mounted on the upper hull 2. Water ballast tanks 4 are installed in the lower hulls 1 for the purpose of changing the state of draft of the ship for various flotation states such as the following. a. The shallow draft state W1-1, where the lower hulls 1 are afloat on the water surface. b. The semisubmerged draft state WL-2, where the lower hulls 1 are submerged and the water breakers 3 are afloat on the water surface. c. The deep submerged draft state WL-3, where the upper hull 2 is submerged and the barges 9 are mounted on the upper hull 2 when the upper hull 2 is elevated above the water surface WL-3. FIG. 3 also shows superstructures 10 which are attached on the upper hull 2 at the fore and aft parts thereof, and which have reserve buoyancy sufficient to maintain the stability of the ship under the deep submerged draft state WL-3. As shown, each of the lower hulls 1 has a steering rudder 6 and a propeller 7.

The water surface WL-1 in FIG. 3 indicates the shallow draft state where the lower hulls 1 are afloat on the water surface by discharging water from the ballast tanks 4 in order to obtain sufficient stability when the effectiveness of the horizontal planes 5 are not sufficient because of slow navigation speed such as the case where the ship is near a port.

The water surface WL-2 in FIG. 3 indicates the semisubmerged draft state which is the ocean navigation state of the ship as the barges 9 carrying cargo 8 are mounted on the upper hulls 2. This state can be obtained by ballasting water into the ballast tanks 4 from the shallow draft state WL-1. The water surface WL-3 in FIG. 3 indicates the deep submerged draft state where the upper hull 2 is submerged by further ballasting water into the ballast tanks 4 from the semisubmerged draft state WL-2. This is the state of draft when the loading and unloading operations are carried out in a port.

Figure 4:
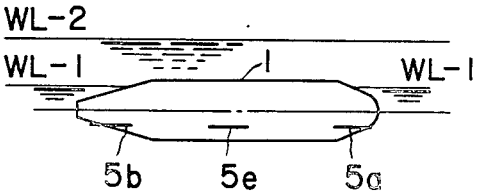
FIG. 4 is a side view of a lower hull provided at an intermediate part with additional planes in addition to bow and stern planes.

FIG. 4 shows a modified lower hull 1 wherein horizontal planes 5e are provided at the mid-part of the ship in addition to the bow and stern planes 5a and 5b of the lower hull 1. Two or more planes can be used.

Figure 5:
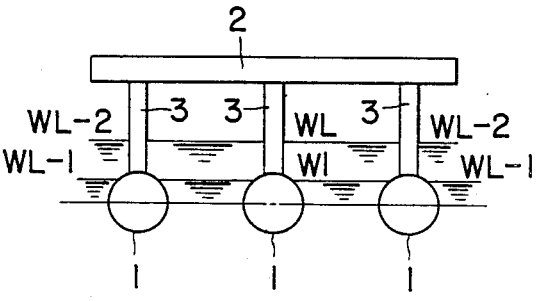
FIG. 5 is a rear view of a modified ship according to this invention wherein lower hulls are provided at the port side, starboard side and at the center.

FIG. 5 shows a modified ship of this invention wherein the lower hulls 1 are installed at the port side, starboard side and at the center. More than two lower hulls can be used.

Figure 6:
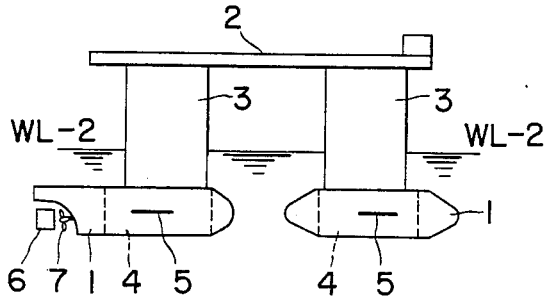
FIG. 6 is a side view of another modified ship wherein the lower hulls are separated longitudinally into fore and aft sections.

In a modified ship shown in FIG. 6, the lower hulls 1 are separated longitudinally into fore and aft sections which have separate water breakers 3.

Figure 7:
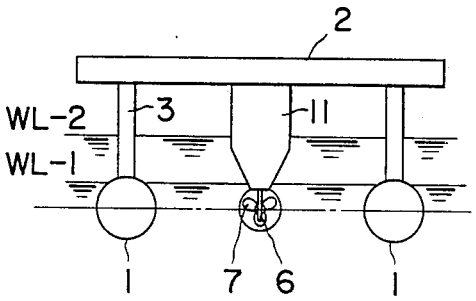
FIG. 7 is a rear view of a further modified ship wherein a steering rudder and a propeller are provided on an underhanging body instead of the stern part of the lower hulls.

FIG. 7 shows another modified ship of this invention wherein a steering rudder 6 and a propeller 7 are provided on an underhanging body 11 instead of the stern part of lower hulls 1. The body 11 is secured to the upper hull 2.

Figure 8:
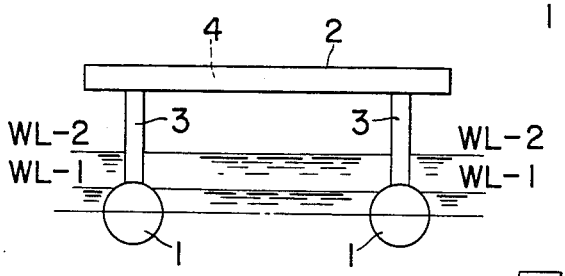
FIG. 8 is a rear view of a still further modified ship wherein water ballast tanks are provided in an upper hull.

In a further modified ship shown in FIG. 8, the water ballast tanks 4 are located in the upper hull 2. The water ballast tanks can be located at any part of the ship as long as the stability of the ship is maintained.

Figure 9:
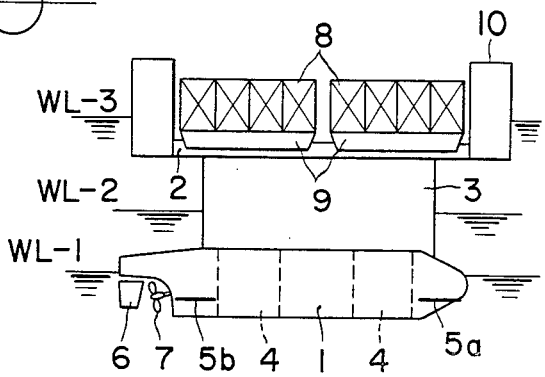
FIG. 9 is a side view of a modified ship carrying separable barges.

FIG. 9 shows a still further modified ship of this invention wherein barges 9 are separated according to the kind and owner of the cargoes 8.

Figure 10:
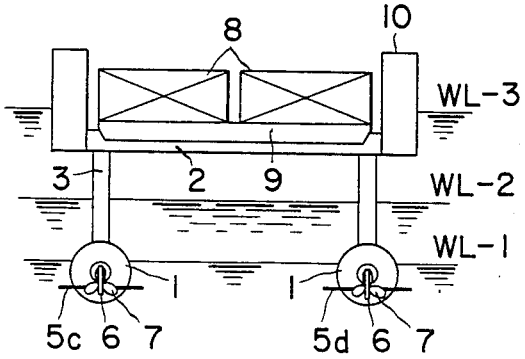
FIG. 10 is a rear view of another modified ship having superstructures on the port and starboard sides.

In the ship shown in FIG. 10, superstructures 10 are installed on the upper hull 2 separately on the port and starboard sides.

Figure 11:
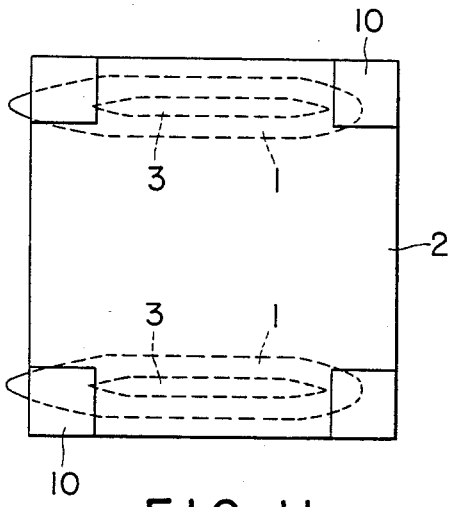
FIG. 11 is a plan view of a further modified ship having four superstructures on the upper hull.

As shown in FIG. 11, superstructures 10 may be installed on the upper hull 2 separately on the port and starboard sides both at the bow and stern parts of the upper hull 2.

Figure 12:
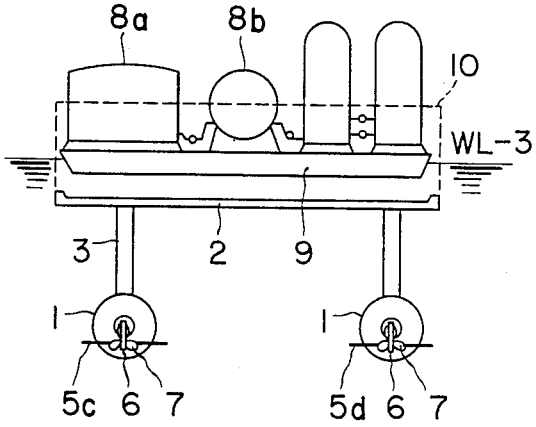
FIG. 12 is a rear view of a still further modified ship wherein a barge carrying a moduled plant is about to be mounted on the upper hull.

FIG. 12 shows a modified ship of this invention wherein a barge 9 carrying moduled plants 8a is about to be mounted on the upper hull 2. FIG. 12 can also indicate the state of the barge to be unloaded from the upper hull 2. The afloat barge 9 separated from the upper hull 2 can be towed to a wharf while carrying the plants 8a and set on land.

Figure 13:
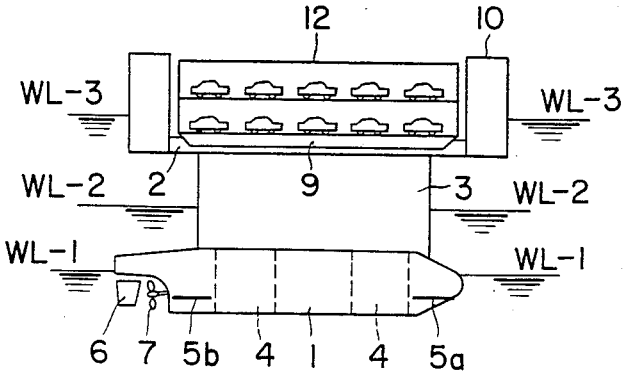
FIG. 13 is a side view of another modified ship wherein a barge is covered with a water-tight enclosure.

As shown in FIG. 13, a barge 9 may be covered with a water-tight enclosure 12 and is carrying automobiles as the cargo in the bare state inside the enclosure.

It will be understood from the foregoing that this invention provides a ship which is not subject to wave-making resistance and which undergoes no rolling or pitching motion during navigation and facilitates cargo handling.

What is claimed is:

1. A semisubmerged water surface ocean navigation ship comprising:

at least two parallel lower hulls which are submerged below the water surface in the cruising state of the ship, each of said lower hulls having controllable horizontal planes provided fore and aft thereof, respectively, to control lifting and diving thereof, said lower hulls also having rudder means for steering said lower hulls, water ballast tank means therein and means for propelling the ship;

water breaker means fixed to the lower hulls and extending upward therefrom;

an upper hull fixedly supported on the upper ends of said water breaker means, said upper hull having means for navigation;

said water ballast tank means causing the water surface to be always between said lower hulls and said upper hull and at a level of an intermediate part of the height of said water breaker means in the cruising state; and said water breaker means having a sufficiently small water plane area and therefore a small reserve buoyancy such that the ship does not have a self-stabilizing ability both longitudinally and transversely thereof and the size of said horizontal planes being such that changes in buoyancy acting on the water breaker means are less than the absolute value of the force of lifting or diving of said horizontal planes, said horizontal planes causing the ship to assume an even draft in the semisubmerged water surface state when the lower hulls are fully submerged and said water breaker means are partly submerged.

2. The ship according to claim 1 further comprising water ballast tanks disposed in parts of the ship other than the lower hulls.

3. The ship according to claim 1, further comprising barge means removably mounted on the upper hull.

4. The ship according to claim 3 wherein the barge means are separable into a plurality of barges.

5. The ship according to claim 1 wherein the upper hull is in the form of a platform.

6. The ship according to claim 5, further comprising superstructure means disposed on the upper hull.

7. The ship according to claim 6 wherein the superstructure means are disposed fore and aft of the upper hull.

8. The ship according to claim 6 wherein the superstructure means are disposed port and starboard of the upper hull.

9. The ship according to claim 1, further comprising controllable horizontal planes provided on a middle part of each of the lower hulls.

10. The ship according to claim 1 wherein said lower hulls are disposed port and starboard of the ship.

11. The ship according to claim 1 wherein said lower hulls are divided into fore and aft sections.

12. The ship according to claim 1 wherein said rudder means and propelling means are provided for each of the lower hulls.

13. The ship according to claim 1 wherein said rudder means and propelling means are provided on a separate underhanging body secured to the upper hull.

14. A method of navigation of a semisubmerged oceangoing ship comprising the steps of:

providing a ship including at least two submerged lower hulls each having controllable horizontal planes fore an aft thereof and water ballast tanks therein, water breaker means fixed to the lower hulls and extending upward therefrom, and an upper hull fixedly supported on the upper ends of the water breaker means, said water breaker means having a sufficiently small water plane area and therefore a small reserve buoyancy such that the ship does not have a self-stabilizing ability both longitudinally and transversely thereof and the size of said horizontal planes being such that changes in buoyancy of water acting on the water breaker means are less than the absolute value of the force of lifting or diving of said horizontal planes;

adjusting said water ballast tanks such that the water surface is between said lower hulls and said upper hull and at a level of an intermediate part of the height of said water breaker in cruising state; and causing the ship to navigate while controlling said horizontal planes such that the buoyancy change of said water breaker means owing to waves will be opposed to and eliminated or cancelled by the force of lifting or diving of said horizontal planes, whereby the ship is caused to assume an even draft in the semisubmerged water surface navigation state.

15. The method according to claim 14, further comprising superstructure means disposed on the upper hull.

16. The method according to claim 15 wherein the superstructure means are disposed fore and aft of the upper hull.

17. The method according to claim 15 wherein the superstructure means are disposed port and starboard of the upper hull.

* * * * *